United States Patent [19]

Rennich

[11] Patent Number: 4,752,155

[45] Date of Patent: Jun. 21, 1988

[54] PAVING MACHINE HAVING MOVABLE HEATER

[75] Inventor: John Rennich, Chattanooga, Tenn.

[73] Assignee: Roadtec, Incorporated, Dalton, Ga.

[21] Appl. No.: 9,360

[22] Filed: Jan. 31, 1987

[51] Int. Cl.[4] ..... E01C 23/14

[52] U.S. Cl. ..... 404/95; 126/271.2 A

[58] Field of Search ..... 404/77, 79, 90, 95; 126/271.2 A; 219/213

[56] References Cited

U.S. PATENT DOCUMENTS

| | | | |
|---|---|---|---|
| 1,247,272 | 11/1917 | Hines | 404/95 |
| 1,408,471 | 3/1922 | Ricks | 126/271.2 X |
| 3,055,280 | 9/1962 | Neville | 404/95 |
| 3,221,617 | 12/1965 | Quigg | 404/95 |
| 3,361,042 | 1/1968 | Cutler | 404/77 |
| 3,907,450 | 9/1975 | Cutler | 404/90 |
| 3,989,401 | 11/1976 | Moench | 404/95 |
| 4,018,540 | 4/1977 | Jackson, Sr. | 404/95 |
| 4,261,669 | 4/1981 | Edo | 404/79 X |
| 4,379,653 | 4/1983 | Brown | 404/95 X |
| 4,561,800 | 12/1985 | Hatakenaka et al. | 404/79 |

FOREIGN PATENT DOCUMENTS

| | | | |
|---|---|---|---|
| 2362968 | 3/1978 | France | 404/95 |

*Primary Examiner*—George A. Suchfield
*Assistant Examiner*—John F. Letchford
*Attorney, Agent, or Firm*—Jones, Askew & Lunsford

[57] ABSTRACT

A paving machine is provided for depositing paving material onto a road surface. The paving machine has a frame mounted for movement along the road and a heater is mounted on the frame. The heater is movable between a first position at which it is capable of heating a width of the road to be paved and a second position at which the heater is stored for movement with the frame and spans a width less than the width of road to be paved.

4 Claims, 4 Drawing Sheets

PAVING MACHINE HAVING MOVABLE HEATER

TECHNICAL FIELD

This invention pertains to a paving machine and more particularly to a pavement heater movably attached to the paving machine.

BACKGROUND ART

Typical paving machines include a vehicle which moves along the area to be paved carrying a hopper which contains a supply of the asphalt paving material and a screed which lays the asphalt paving material onto the area to be paved in a strip of uniform thickness. The asphalt paving material is heated and is applied when it has a plastic consistency so that it may be easily applied in a layer of uniform thickness. In a repaving operation, the new asphalt material may be laid upon the old surface of the roadway. It has been found that the new asphalt material adheres to the old road surface much better when the old road surface is warm. Poor results are obtained when the new asphalt material is applied upon a cold roadway. For this reason, specific temperature conditions exist under which paving must occur to ensure pavement quality. This limits the length of the paving season and the productivity on days when paving crews must wait for the temperature to rise.

In some places, there are only a few brief months when the weather temperature is sufficient to meet the condition for obtaining good results when paving. It has been found advantageous to mount heating apparatus on the paving machine which heats the road surface prior to depositing the new paving material on the road surface. This heating of the road surface raises the pavement temperature to assure a good bonding between the road surface and the new asphalt material.

Paving machines can be relatively large, cumbersome machines especially when equipped with the hopper, screed and heater. The screed width is adjustable so that it can be retracted for travel from one work site to the other and then fully extended for the paving operation. Since the screed is retractable, it is not a limiting factor in the width of the paving machine.

On the other hand, the width of the heater is ideally at least about equal to the screed width and is a limiting factor because it is not adjustable as is the screed. On some prior paving machines, the heater is vertically adjustable so that it can be moved downwardly for heating the road surface and moved upwardly for transport, but is not horizontally adjustable. Since the heater must heat a strip of the road surface which is at least equal to the width of the maximum extension of the screed, the heater is the widest part of the machine and thus limits the transportability of the paving machine. Examples of pavement heaters on prior paving machines are shown in U.S. Pat. Nos. 4,018,540; 3,361,042; 3,221,617 and 3,055,280. Accordingly, it will be appreciated that it would be highly desirable to provide a heater for a paving machine which does not limit the transportability of the paving machine.

SUMMARY OF THE INVENTION

Briefly stated, in accordance with one aspect of the invention, a paving machine for depositing paving material onto a road has a frame mounted for movement along the road. A heater is mounted on the frame. Means are provided for moving the heater between a first position at which the heater is capable of heating a width of the road to be paved and a second position at which the heater is stored for movement with the frame and spans a width less than the width to be paved.

An object of the present invention is to provide a paving machine which has a heater which does not limit the transportability of the paving machine. This object is achieved by providing a heater which is movable between first and second positions. At the first position the heater is positioned for heating a strip of road to be paved. At the second position the heater is stored for movement with the vehicle to a new work location and spans a width less than the width of road to be paved.

Another object of the present invention is to provide a heater which can easily be moved from a working position to a position for transport. This object is achieved by providing a heater which is movable between a first position at which the heater is capable of heating a strip of road to be paved and a second position at which the heater is stored for movement with the vehicle and spans a width less than the width of road to be paved. The heater moves horizontally, from a working position beneath the vehicle frame over the road surface to be heated, to an intermediate position, and moves vertically from the intermediate position to a transport position. In the storage or transport position the heater is vertically oriented alongside the vehicle and does not protrude laterally beyond the vehicle.

DETAILED DESCRIPTION OF THE PREFERRED EMBODIMENTS

Figure 1:
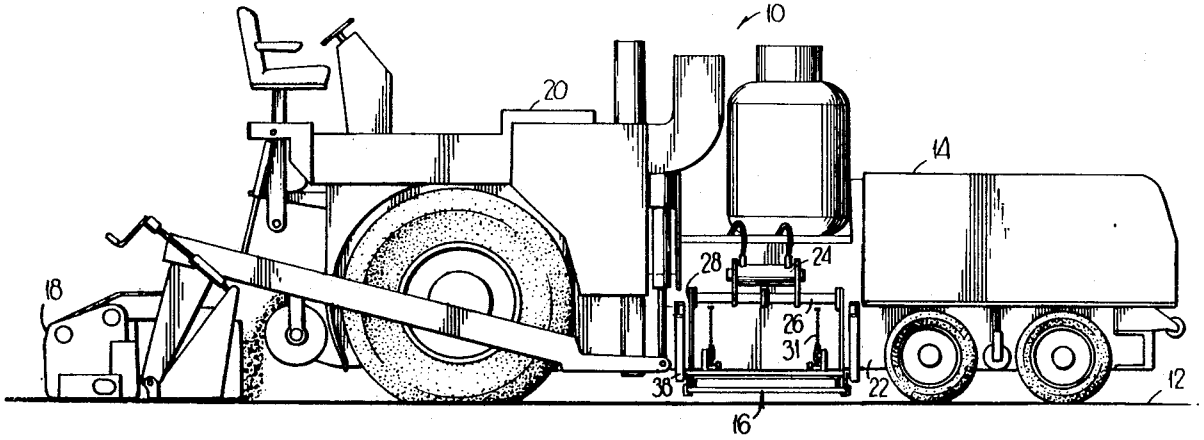
FIG. 1 is a diagrammatic side view of a preferred embodiment of a paving machine constructed in accordance with the present invention illustrating the relative positions of the heater and screed on the paving machine with the heater in a pavement heating position.
Figure 2:
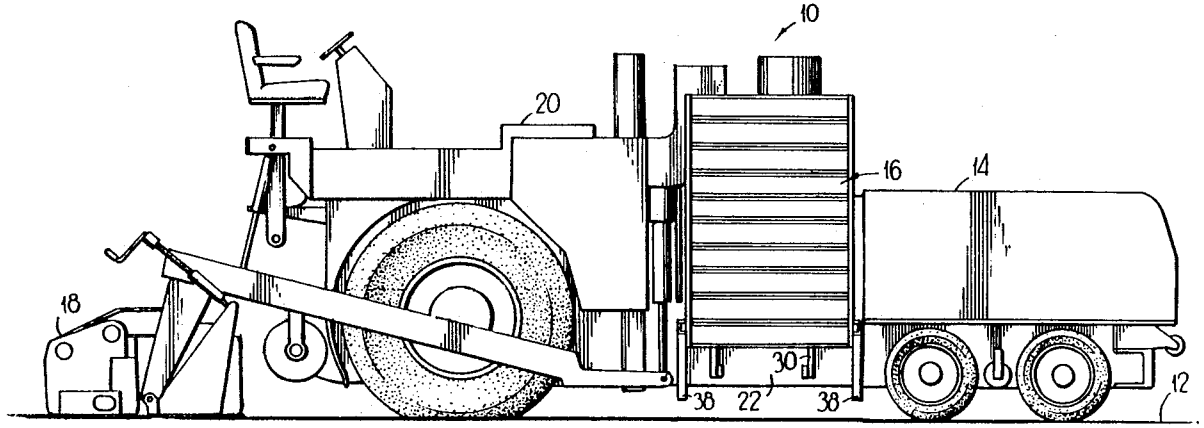
FIG. 2 is a side view similar to FIG. 1 but illustrating the heater in a retracted position for transport.

Referring to FIGS. 1 and 2, a paving machine 10 is positioned for depositing paving material onto a road 12. The paving machine 10 preferably has a hopper 14 which is a holding bin for the asphalt paving material which will be deposited upon the surface of the road 12. The paving machine 10 includes a heater 16 which warms the surface of the road 12 prior to applying the asphalt to ensure a good bonding of the new asphalt material to the surface of the road 12. The paving machine 10 has a screed 18 which deposits the asphalt paving material onto the surface of the road 12 in a uniform layer. The paving machine 10 also includes a vehicle 20 to which the hopper 14, heater 16, and screed 18 are attached. The vehicle provides the motive power for moving the hopper, heater and screed along the road. As is known in the art, the paving material is conveyed from the hopper 14 to the screed 18 so that it may be deposited upon the surface of the road 12.

The paving machine 10 includes a frame 22 to which the heater 16 is attached. The frame 22 is oriented parallel to the surface of the roadway 12. The heater is movable relative to the frame from a first position shown in FIG. 1 to a second position shown in FIG. 2. At the first position, the heater 16 is in a working position at which it is lowered and positioned beneath the frame 22 and is oriented parallel to the surface of the road 12 and is spaced a preselected distance from the road 12 for optimum heat transfer and road clearance. At the second position, the heater 16 is generally vertically oriented relative to the frame 22 and is removed from its position between the frame and roadway to a position at which it is generally at a higher elevation than the frame 22 and is clear of the roadway 12. At the second position, the heater 16 spans a width which is less than the width of the screed 18; while, at the first position, the heater spans a width about equal to the width of the screed. Thus, at the second position, the heater is not the widest member of the paving machine and has a width less than the width of the screed even when the screed is in a fully retracted position. This facilitates movement of the paving machine 10 from one work location to another.

Figure 3:
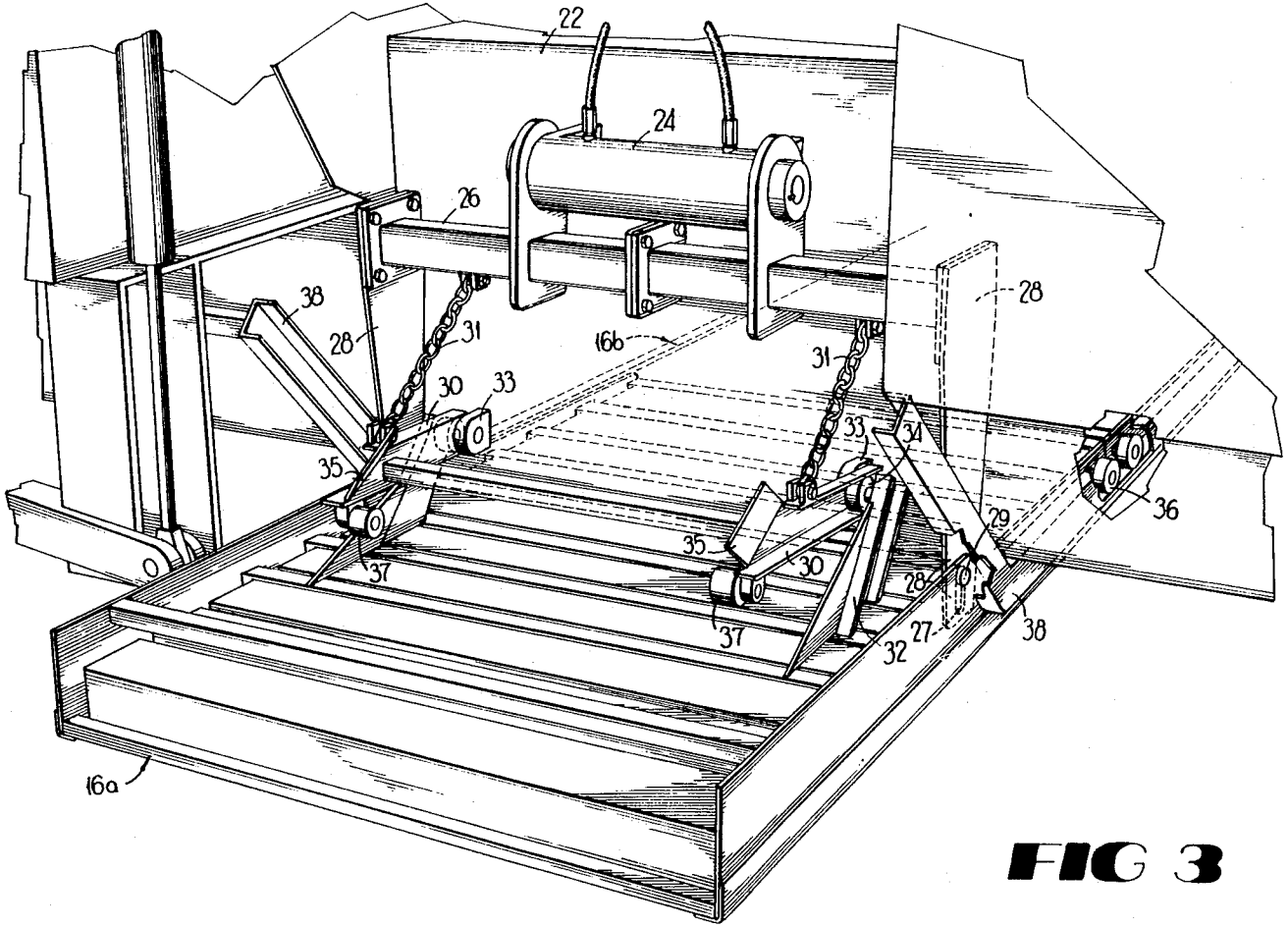
FIG. 3 is a somewhat enlarged isometric view of the heater of FIG. 1 illustrating the linkage assembly which makes possible the movement of the heater from the pavement heating position of FIG. 4 to the transport postion of FIG. 9.

Referring to FIG. 3, the heater 16 includes a plurality of individual heating elements which are placed side by side in an assembly to form the heater. The number of individual heating elements will vary depending upon the width of the heater desired, which, in turn, depends upon the width of road surface to be heated. As is known in the art, the heater elements are supplied with fuel, such as propane gas for example, from a storage tank mounted on the paving machine. The fuel is fed through a flexible line to the heater by the individual heating elements are then fed by rigid metallic lines (not shown). Because the fuel lines are rigid metallic elements, the heating elements are bound together in the heater assembly forming a rigid heater. In the past the rigid heater assembly was constructed so that it was about as wide as the surface of road to be paved. The rigid assembly was mounted on the frame on the underside of the paving machine so that it was positioned between the frame and the roadway.

These rigid assemblies were vertically adjustable so that they could be moved down for heating the road and then retracted vertically upward a slight distance for transport of the paving machine. Even with this vertical adjustment possible, the heater was generally the lowest element of the paving machine and was subject to damage when moved over the roadway. Also, since the heater was as wide as the stretch of pavement to be heated, it was often the widest portion of the paving machine and a limiting factor as far as the transportability of the paving machine was concerned. These disadvantages are overcome with the present invention as will be more fully explained.

Referring to FIGS. 3–9, the heater 16 is movable between a first position at which the heater is capable of heating a width of road to be paved and a second position at which the heater is stored for movement with the frame 22 and spans a width less than the width of road to be paved. This movement between the first and second positions is facilitated by dividing the heater 16 into two components, **16*a* and 16*b*. As best shown in FIGS. 4–9, the heater 16*a* is associated with the right side of the paving machine and the heater 16*b* is associated with the left side of the paving machine. At the first position, the heaters 16*a* and 16*b* are positioned beneath the paving machine adjacent one another so that they span the width of road to be paved. Each of the heaters 16*a*, 16*b* is a rigid structure which can be moved from the position in FIG. 4 horizontally to the position in FIG. 5 where the heaters 16*a* and 16*b*** are horizontally separated from one another temporarily spanning an overall width greater than the width of the road to be paved.

Figure 4:
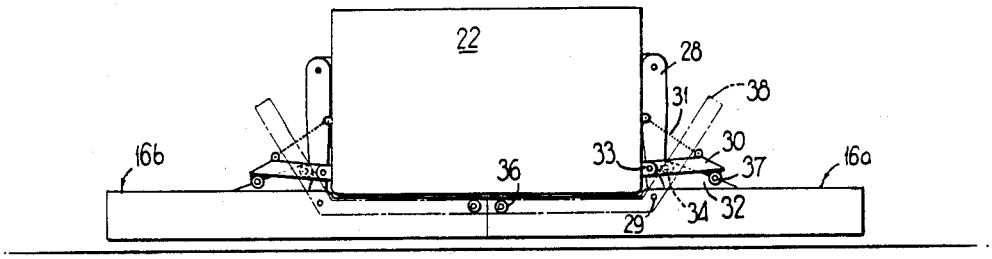
FIG. 4 is a diagrammatic cross-sectional view of the preferred embodiment of FIG. 1 illustrating the relative positions of the first and second heating elements in the pavement heating position.
Figure 9:
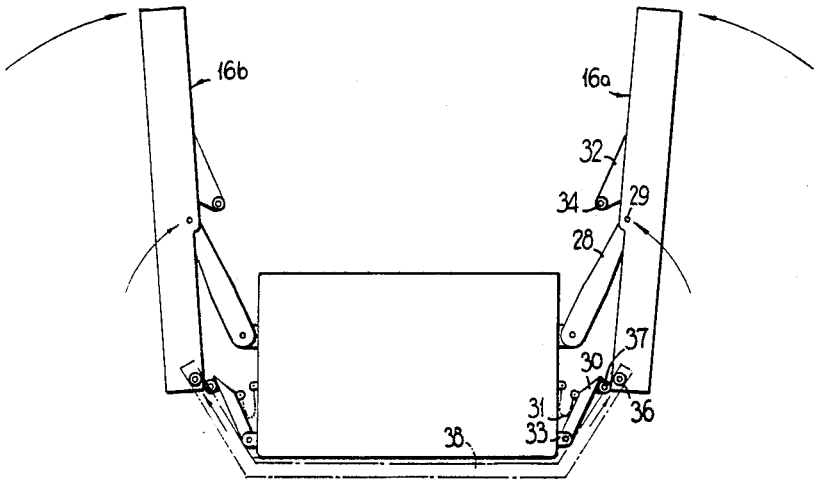
FIG. 9 is a diagrammatic cross-sectional view of the heating elements in the storage position ready for transport.

This horizontal outward motion is required so that the heaters **16*a*, 16*b* can be moved from the paving position of FIG. 4 to the transport position of FIG. 9. In moving from the position shown in FIG. 5 to the position shown in FIG. 9, the heaters 16*a* and 16*b* move horizontally outward and vertically upward in an arcuate path that will be more fully explained in connection with FIGS. 6–9 below. By arranging the heater 16 in two sections, 16*a* and 16*b*, the heater section 16** can be swung from beneath the paving machine to a position alongside the paving machine so that it does not protrude beyond the general dimensions of the paving machine and does not pose a limitation on the mobility of the paving machine.

Now referring to FIG. 3, heater section **16*a* is illustrated in greater detail. It is to be understood that the heater element 16*b* is connected to the paving machine on the left side just as heater 16*a* is connected on the right side. Their connections and movements are equivalent although their movements are in opposite directions. Motive power for moving the heater between the first and second position is provided by a hydraulic jack or motor 24 which, in this case, has a stationary member fastened to the frame 22 and has a movable member which rotates relative to the stationary member. The rotating member is connected to a cross arm or cross member 26 which has arms 28 connected on its ends. For simplicity of discussion and illustration only one arm 28 will be discussed. It will be understood that the other side of the heater has an arm and associated members as does the side which will be discussed herein. Hydraulic motor 24 is activated by hydraulic fluid which enters and causes the rotating member to rotate which causes the cross member 26 to move away from the frame 22 in an arcuate path and also causes the arm 28, which is connected to the cross member 26**, to move in an arcuate path.

The heater **16*a* is pivotally connected to the free end of the arm 28 which is opposite the end which is connected to the cross member 26. The free end of the arm 28 has a slot 27 therein which engages a boss 29 on the heater 16*a* to make a sliding pivotal connection. Thus, at the point of connection of the arm 28 and the heater 16, the slot 27 traverses a true arcuate path as the boss 29 traverses a path which is first horizontal, then arcuate. Since the slot 27 is a greater distance from the rotating member of the hydraulic motor 24 than the cross arm 26, the arcuate path radius of the slot 27** is greater.

Still referring to FIG. 3 , a bracket 30 is pivotally connected to the frame 22 at a pivot axle 33 and is free to pivot or rotate vertically relative to the frame. The bracket 30 is preferably a C shaped channel member and is preferably supported by a chain 31 or other flexible, inextensible member so that its downward motion is limited. As illustrated, the bracket 30 is generally horizontal in the lowered position of the heater 16*a* and the chain 31 is taut to provide support for the heater 16 in this position (FIG. 3). The heater 16*a* also has attached thereto a bracket 32 which in turn preferably has a roller 34 attached thereto. The roller engages the C shaped channel of the bracket 30 and rollably travels therein. One end of the C shaped channel bracket 30 is pivotally attached to the frame 22 and the other end of the C shaped channel bracket 30 has a flange 35 which guides the roller 34. The roller 34 disengages the bracket 30 as the heater 16*a* is raised (FIGS. 6–9). The bracket 30 also has a roller 37 attached hereto which makes rolling contact with the heater 16*a* as the heater moves between the paving and transport positions.

The brackets 30, 32 arm 28 and roller 34 and other members have been described with reference to the right side of heater 16*a*. It is to be understood that there is a corresponding arm, roller and brackets for the left side of the heater 16*a* which operate in conjunction with the elements described above during movement of the heater between the first and second positions. Similarly, the heater 16*b* is equipped in the same manner for movement between the first and second positions.

Referring to FIG. 4, the heater 16*a* is shown in the working position where it is in the down position between the road surface to be paved and the frame 22 adjacent the other heater 16*b*. Together, heaters 16*a* and 16*b* span the width of road to be paved. To move the heater 16*a* from the first position shown in FIG. 4 to the intermediate position shown in FIG. 5, the hydraulic motor 24 is activated. Activating hydraulic motor 24 causes the cross member 26 and the arm 28, which is attached to the cross member 26, to move in their respective paths in a counterclockwise direction. As the arm 28 moves away from the frame, the heater 16*a* moves horizontally, out away from heater 16*b* in a direction away from the frame.

Since the heater 16*a* is slidably, pivotally connected to the slotted arm 28 and the bracket 32 is rigidly fixed to the heater 16*a* but slidably movable along the bracket 30, the arcuate motion of the arm is not completely transferred to the heater 16*a*. Rather, the arcuate motion results in movement of the roller 34 along the channel bracket 30 and of the boss 29 along the slot 27, so that the resultant motion of the heater 16*a* is horizontal motion away from the frame 22. This horizontal motion continues until the roller 34 reaches the end of the channel 30 and the boss 29 reaches the bottom of the slot 27. At this point the roller 34 disengages the channel 30 and the heater 16*a* is in the position indicated in FIG. 6.

Again referring to FIG. 3, the heater 16*a* has a roller 36 connected on the end which extends under the frame 12 adjacent the other heater 16*b*. The roller 36 rides in a track 38 which is attached to the frame 22 of the vehicle 20. The track 38 is preferably a C shaped metal channel member which is rigidly connected to the frame 22. The track 38 has a general "L" configuration with one leg of the L extending under the frame 22 and being connected thereto. The other leg of the L extends in a generally vertical direction so that the roller 36 traverses a path which is horizontal for a distance before angling upward. The angle between the legs of the L is an obtuse angle. Naturally, there is a corresponding roller and bracket for the other side of the heater 16*a*. The other heater element 16*b* is similarly equipped.

Figure 6:
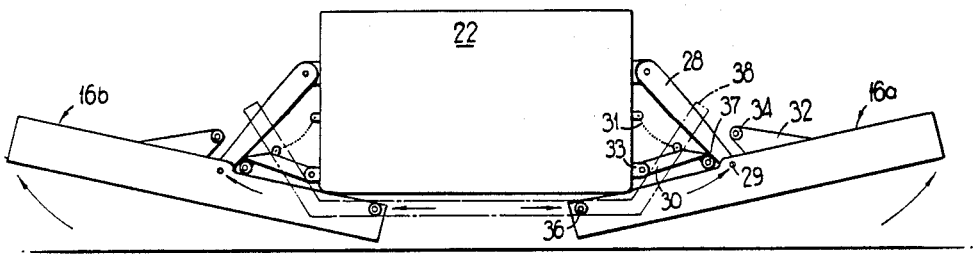
FIG. 6 is a diagrammatic cross-sectional view similar to FIGS. 4 and 5 but showing the heating elements as they move vertically from the intermediate position.
Figure 7:
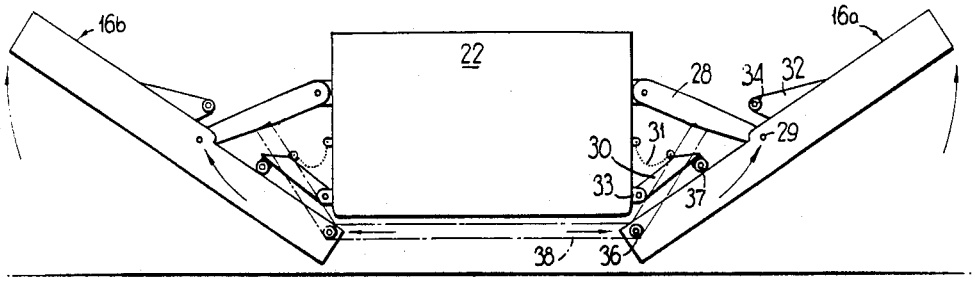
FIG. 7 is a diagrammatic cross-sectional view showing the heating elements as they move vertical from the position illustrated in FIG. 6.
Figure 8:
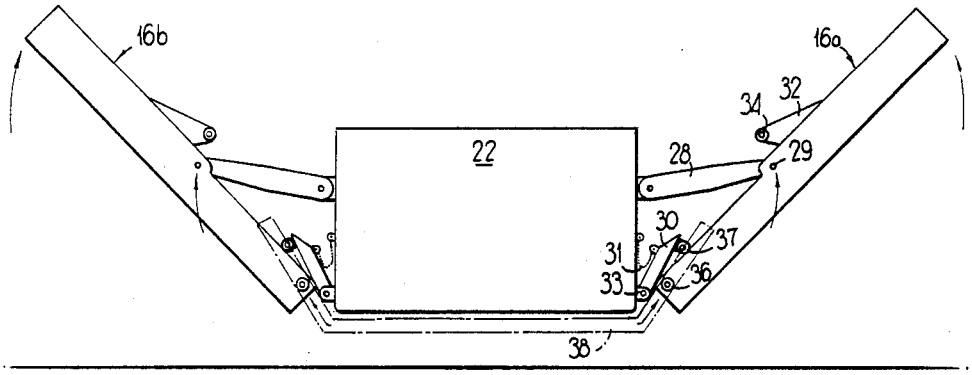
FIG. 8 is a diagrammatic cross-sectional view showing the heating elements as they move verticaly from the position illustrated in FIG. 7.

Further arcuate motion of the arm 28 from the position in FIG. 6 causes the heater 16*a* to pivot about the roller 36 so that it moves generally vertically in an arcuate path to the position indicated in FIG. 7. Further arcuate motion of the arm 28 causes the roller 36 to rise up in the track 38 to the positions indicated in FIGS. 8 and 9. The heater is now ready to be transported with the paving machine to a new work location.

Figure 5:
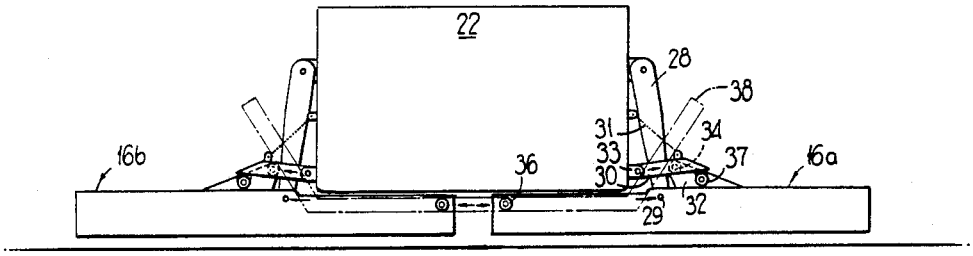
FIG. 5 is a diagrammatic cross-sectional view similar to FIG. 4 but showing the heating elements moved laterally to an intermediate position.

In moving the heater 16*a* from the transport position indicated in FIG. 9 to the working position indicated in FIG. 4, the arm 28 is moved clockwise in a arcuate path causing the heater to move generally vertically downward to the position of FIG. 6 at which point the heater 16*a* pivots to the position indicated in FIG. 5. The rollers 34 initially engage the flanges 35 and are guided into the channels 30. Further movement of the arm causes the heater to move horizontally back to the position indicated in FIG. 4.

Operation of the paving machine 10 is believed to be apparent from the description above but a few words will be rendered for enlightenment. Initially, the paving machine 10 is transported to the work site. To transport the paving machine 10, the variable width screed 18 is fully retracted to its minimum width and the heater 16 is raised occupying a width no greater than the fully retracted width of the screed 18. To pave a strip of road, paving material is inserted into the hopper 14 and fed to the screed 18. The heater 16 is moved from its raised position to a lowered working position where the two heater elements 16*a*, 16*b* are positioned between the road surface 12 and the frame 22 of the machine 10 and abut one another so that the width of the two heater elements 16*a*, 16*b* spans the width of road 12 to be paved. The screed 18 is extended to a maximum extension for paving. The heater 16 spans a width about equal to the width of the screed 18 at its maximum extension. As the paving machine 10 moves along, the heater 16 heats the road surface and the screed 18 applies a uniform layer of asphalt paving material onto the heated road surface.

It will now be understood that there has been presented a paving machine for depositing paving material onto a road which has a frame mounted for movement along the road to be paved. Means for heating the road prior to depositing paving material onto the road are mounted on the frame. Means are provided for moving the heating elements between a first position at which the heating means is capable of heating a width of road to be paved and a second position at which the heating means is stored for movement with the frame and spans a width less than the width of road to be paved.

The paving machine includes a variable width screed which is extendable from a fully retracted width to a maximum extension. In the first position the heating means spans a width equal to the width of the screed at its maximum extension. In the second position, the heating means spans a width no greater than the fully retracted width of the screed. The heating means includes a first movable heating element and a second movable heating element. At the first position the heating elements are positioned adjacent one another. The first and second heating elements move horizontally away from one another during movement to an intermediate position between the first and second positions. The first and second heating elements move generally vertically from the intermediate position to the second position. Each of the heating elements is independently movable between the first and second positions.

It will also be understood that there has been presented a paving machine with a heater which can easily be moved from a lowered working position to a raised transporting position. In the position for transport, the heater spans a width no greater than a fully retracted width of the variable width screed, so that the heater is not so wide as to limit the transportability of the paving machine. Since the heater is raised for transport and is not located between the vehicle frame and the roadway, there is no danger of damaging the heater during transport over uneven roads or terrain. Also, the heater is divided into two sections with each section being movable, independently of the other, between the first and second positions. This increases the versatility of the paving machine.

As will be evident from the foregoing description, certain aspects of the invention are not limited to the particular details illustrated, and it is therefore contemplated that other modifications or applications will occur to those skilled in the art. For example, while the best mode for operating the invention calls for only heating the surface of the road to be paved with the heater in the first position, a road surface can also be heated with the heaters in the intermediate position. Also, one centrally located arm and centrally located set of brackets, roller and chains can be used instead of the dual sets illustrated which are preferred. While the invention has been described in relation to a variable width screed, it is equally applicable where the screed width is fixed or adjusted by adding and removing fixed extensions. It is accordingly intended that the claims shall cover all such modifications and applications as do not depart from the true spirit and scope of the invention.

What is claimed is:

1. A paving machine for depositing paving material onto a road, comprising:

a frame mounted for movement along said road;

first and second spaced-apart tracks mounted on said frame;

means for heating said road;

first and second rollers attached to said heating means and riding on said first and second tracks, respectively;

a channel bracket pivotally connected to the frame;

a bracket fastened to said heating means and having a roller engaging said channel bracket;

an arm pivotally connected to said frame; and moving means, connected to said frame and said arm, for moving said heating means between a first position at which said heating means is capable of heating a width of said road to be paved and a second position at which said heating means is stored for movement with said frame and spans a width less than said width of road to be paved.

2. The paving machine of claim 1, wherein said first and second tracks each have a general "L" configuration with one leg of the L fastened to said frame and the other leg extending upwardly at an obtuse angle from the one leg.

3. The paving machine of claim 1 including a flexible, inextensible connector having one end connected to said frame and the other end connected to said channel bracket limiting the pivotally motion of said channel bracket.

4. The paving machine of claim 1 including a roller connected to said channel bracket and positioned for rolling contact with said heating means.

* * * * *